US005818391A

United States Patent [19]

Lee

[11] Patent Number: 5,818,391

[45] Date of Patent: Oct. 6, 1998

[54] MICROSTRIP ARRAY ANTENNA

[75] Inventor: Choon Sae Lee, Dallas, Tex.

[73] Assignee: Southern Methodist University, Dallas, Tex.

[21] Appl. No.: 816,357

[22] Filed: Mar. 13, 1997

[51] Int. Cl.[6] ..... H01Q 1/38

[52] U.S. Cl. ..... 343/700 MS; 343/769

[58] Field of Search ..... 343/770, 700 MS, 343/769, 846; H01Q 1/38

[56] References Cited

U.S. PATENT DOCUMENTS

| | | | |
|---|---|---|---|
| 4,633,262 | 12/1986 | Traut | 343/700 MS |
| 4,651,159 | 3/1987 | Ness | 343/700 MS |
| 4,755,821 | 7/1988 | Itoh et al. | 343/700 MS |
| 4,843,400 | 6/1989 | Tsao et al. | 343/700 MS |
| 4,947,178 | 8/1990 | Shafai | 343/700 MS |
| 4,994,817 | 2/1991 | Munson et al. | 343/770 |
| 5,194,876 | 3/1993 | Schnetzer et al. | 343/769 |
| 5,278,569 | 1/1994 | Ohta et al. | 343/700 MS |
| 5,355,143 | 10/1994 | Zurcher et al. | 343/700 MS |
| 5,418,541 | 5/1995 | Schroeder et al. | 343/700 MS |
| 5,471,221 | 11/1995 | Nalbandian et al. | 343/700 MS |
| 5,510,803 | 4/1996 | Ishizaka et al. | 343/700 MS |
| 5,539,420 | 7/1996 | Dusseux et al. | 343/769 |
| 5,561,435 | 10/1996 | Nalbandian et al. | 373/700 MS |
| 5,563,613 | 10/1996 | Schroeder et al. | 343/700 MS |
| 5,581,266 | 12/1996 | Peng et al. | 343/770 |

OTHER PUBLICATIONS

James et al, "Superimposed Dichroic Microstrip Antenna Arrays," IEE Proceedings, vol. 135, Pt. H., No. 5, Oct. 1988.

*Primary Examiner*—Michael C. Wimer

*Attorney, Agent, or Firm*—David L. McCombs; Jack D. Stone

[57] ABSTRACT

A microstrip antenna has two dielectric layers bonded together with an array of conducting strips interposed therebetween, the strips being spaced to define a slot between each pair of adjacent strips. A conductive ground plane is disposed on a first outer side of the two bonded dielectric layers, and an array of radiating patches are disposed on a second outer side of the two bonded dielectric layers, each of which patches is positioned over a corresponding slot, the array of patches being spaced apart to form an aperture between each pair of adjacent patches. Responsive to electromagnetic energy, a high-order standing wave is induced in the antenna and a directed beam is transmitted from and/or received into the antenna.

32 Claims, 4 Drawing Sheets

MICROSTRIP ARRAY ANTENNA

BACKGROUND OF THE INVENTION

The invention relates generally to antennas and, more particularly, to microstrip array antennas.

The number of direct satellite broadcast services has substantially increased world-wide and, as it has, the world-wide demand for antennas having the capacity for receiving such broadcast services has also increased. This increased demand has typically been met by reflector, or "dish", antennas, which are well known in the art. Reflector antennas are commonly used in residential environments for receiving broadcast services, such as the transmission of television channel signals, from geostationary, or equatorial, satellites. Reflector antennas have several drawbacks, though. For example, they are bulky and relatively expensive for residential use. Furthermore, inherent in reflector antennas are feed spillover and aperture blockage by a feed assembly, which significantly reduces the aperture efficiency of a reflector antenna, typically resulting in an aperture efficiency of only about 55%.

An alternative antenna, such as a microstrip antenna, overcomes many of the disadvantages associated with reflector antennas. Microstrip antennas, for example, require less space, are simpler and less expensive to manufacture, and are more compatible than reflector antennas with printed-circuit technology. Microstrip array antennas, i.e., microstrip antennas having an array of microstrips, may be used with applications requiring high directivity. Microstrip array antennas, however, typically rely on traveling waves and require a complex microstrip feed network which contributes significant feed loss to the overall antenna loss. Furthermore, many microstrip array antennas are limited to transmitting and/or receiving only a linearly polarized beam. Such a drawback is particularly significant in many parts of the world where broadcast services are provided using only circularly polarized beams. In such instances, the recipients of the services must resort to less efficient and more expensive, bulky reflector antennas, or microstrip array antennas which utilize a polarizer. A polarizer, however, introduces additional power loss to the antenna and produces a relatively poor quality radiation pattern.

What is needed, then, is a low-cost, compact antenna having a high aperture efficiency, and which does not require a complex feed network, and which can be readily adapted for transmitting and/or receiving either linearly polarized or circularly polarized beams.

SUMMARY OF THE INVENTION

The present invention, accordingly, provides for a low-cost, compact antenna having a high aperture efficiency, and which does not require a complex feed network, and which can be readily adapted for transmitting and/or receiving either linearly polarized or circularly polarized beams. To this end, a microstrip antenna of the present invention includes two dielectric layers bonded together with an array of conducting strips interposed therebetween, the strips being spaced to define a slot between each pair of adjacent strips. A conductive ground plane is disposed on a first outer side of the two bonded dielectric layers, and an array of radiating patches are disposed on a second outer side of the two bonded dielectric layers, each of which patches is positioned over a corresponding slot, the array of patches being spaced apart to form an aperture between each pair of adjacent patches. Responsive to electromagnetic energy, a high-order standing wave is induced in the antenna and a directed beam is transmitted from and/or received into the antenna.

An advantage achieved with the present invention is that a much higher aperture efficiency may be achieved than is generally possible with reflector antennas or other microstrip antennas.

Another advantage achieved with the present invention is that it utilizes a high-order standing wave which is more efficient than a traveling wave generally utilized in microstrip array antennas.

Another advantage achieved with the present invention is that the radiation patterns it generates are of a higher quality than is typically generated by other microstrip array antennas.

Another advantage achieved with the present invention is that it is relatively thin and flat and, consequently, is much smaller, lighter, and less bulky than reflector antennas, and may be readily incorporated into existing receiver/transmitter systems.

Another advantage achieved with the present invention is that it may be manufactured much more simply than reflector antennas and, therefore, may be provided at a small fraction of the cost of a reflector antenna.

DETAILED DESCRIPTION OF THE PREFERRED EMBODIMENT

Figure 1:
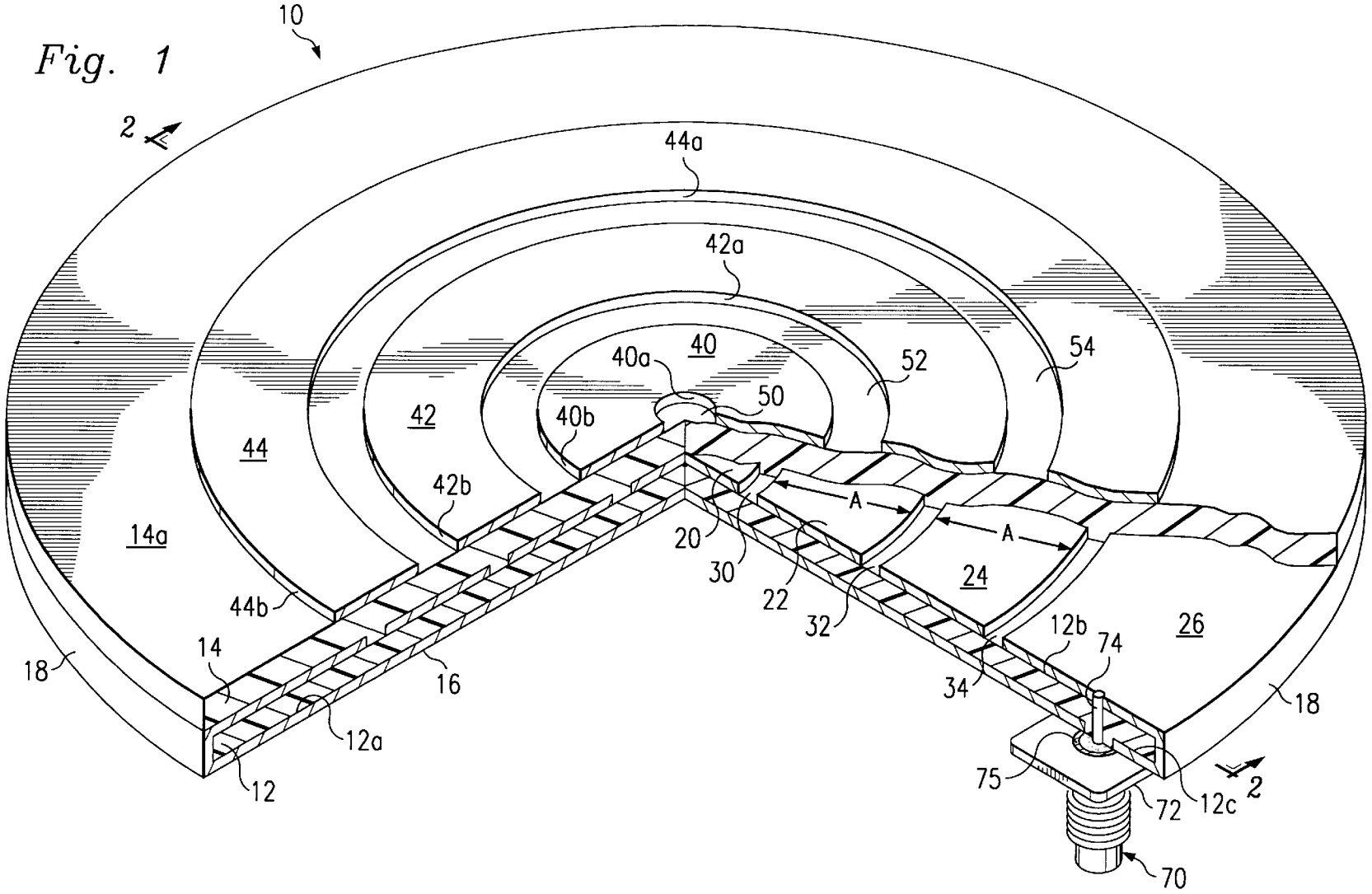
FIG. 1 is a partially cut-away perspective view of a planar array antenna embodying features of the present invention.
Figure 2:
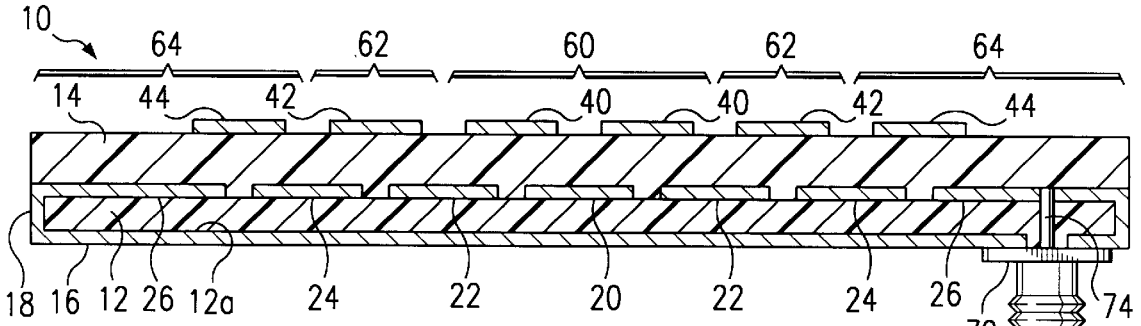
FIG. 2 is a side elevational view of the antenna of FIG. 1 taken along the line 2—2 of FIG. 1.

Referring to FIGS. 1 and 2, the reference numeral 10 designates, in general, a planar microstrip array antenna embodying features of the present invention for transmitting and receiving beams of electromagnetic (EM) energy. As viewed in FIG. 2, the antenna 10 includes thin, round, disc-shaped, first and second dielectric layers 12 and 14, respectively, fabricated from a mechanically stable material having a relatively low dielectric constant, such as 2.2. An example of such a dielectric material is RT/duroid™; 5880, available from the Rogers Corporation, located in Chandler, Arizona. While both dielectric layers 12 and 14 may be fabricated from the same material, it is not necessary that the same material be used in both layers and, depending on the application of the antenna, performance may be enhanced by using in each layer different materials, each having different dielectric constants.

Each of the dielectric layers 12 and 14, preferably, have a thickness (i.e., the vertical dimension as viewed in FIGS. 1 and 2) of between 0.003 $\lambda$ and 0.050 $\lambda$. The diameter of the layers 12 and 14 is determined by the number of strips and patches used, as discussed below. It is understood that, unless specified otherwise, $\lambda$ is taken as the wavelength of a beam of EM energy in free space (i.e., $\lambda$=c/f, where c is the speed of light in free space, and f is the frequency of the beam). It is further undertood that elements defined herein as "strips" and "patches" constitute microstrips.

The first dielectric layer 12 defines a bottom side 12*a* to which a conductive ground plane 16 is bonded, and a top side 12*b* to which a conductive center strip 20 and an array of three spaced concentric conductive annular strips 22, 24, and 26 are bonded for forming a radial transmission line cavity within the dielectric layer 12. The annular strips 22, 24, and 26 have thicknesses (which, for the sake of clarity, are not shown to scale in FIGS. 1 and 2) of approximately 1 mil (i.e., 0.001 inch). The diameter of the center strip 20 and the width (i.e., the radial dimension, such as the dimension A depicted in FIG. 1) of each of the annular strips 22 and 24 is approximately $\lambda/2$, and the width of the annular strip 26 is preferably between $\lambda/2$ and $3\lambda/4$ (though it may be as low as $\lambda/4$ if an SMA probe, described below, is not attached to the strip 26), and the strips 22, 24, and 26 are spaced to form between adjacent strips thereof concentric annular coupling slots 30, 32, and 34, each of which slots has a width that is preferably between 0.01 $\lambda$ and 0.20 $\lambda$. The dielectric layer 12 also defines an outer peripheral edge 12*c* to which an edge conductor 18 is preferably bonded for providing a conductive (i.e., a shortening termination) surface for preventing unwanted leakage of radiation from the peripheral edge thereof and, thereby, controlling radiation to a greater extent so that a more desirable radiation pattern is produced from the antenna 10. The thickness of the ground plane 16 and of the edge conductor 18 are approximately 1 mil (i.e., 0.001 inch), but may be more than one mil (e.g., 0.125 inch), as desired, for providing structural support to the antenna 10.

The ground plane 16, edge conductor 18, and strips 20, 22, 24, and 26 comprise conductive materials such as copper, aluminum, and silver, and are preferably bonded to the dielectric layer 12 using conventional printed-circuit, metallizing, decal transfer, monolithic microwave integrated circuit (MMIC) techniques, or chemical etching techniques, or any other suitable technique. For example, in accordance with a chemical etching technique, the dielectric layer 12 is clad to one of the foregoing conductive materials, and the slots 30, 32, and 34 are chemically etched away from the layer 12 using conventional etching techniques, thereby defining the desired array of strips 20, 22, 24, and 26.

The second dielectric layer 14 is bonded to the top surface 12*b* of the first dielectric layer 12 and to the strips 20, 22, 24, and 26 using any suitable technique, such as creating a bond with very thin (e.g., 1.5 mil) thermal bonding film (not shown) having a dielectric constant of 2.3. The second dielectric layer 14 defines a top surface 14*a* to which an array of three annular concentric radiating patches 40, 42, and 44 are bonded using conventional printed-circuit, metallizing, decal transfer techniques, MMIC techniques, or chemical etching, or any other suitable technique. Each of the patches 40, 42, and 44 have thicknesses (which, for the sake of clarity, are not shown to scale in FIGS. 1 and 2) of approximately 1 mil (0.001 inch), widths (i.e., radial dimensions) preferably between $\lambda/4$ and $\lambda/2$, are positioned over the annular slots 30, 32, and 34, respectively, and are spaced so that a center aperture 50 and two concentric annular apertures 52 and 54 are formed between adjacent patches, each of which apertures have widths that are preferably between 0.01 $\lambda$ and 0.20 $\lambda$. The patches 40, 42, and 44, furthermore, define open (i.e., radiating) edges 40*a*, 40*b*, 42*a*, 42*b*, 44*a*, 44*b*.

For optimal performance at a particular frequency, the widths (i.e., the radial dimensions) of the strips 20, 22, 24, 26, the slots 30, 32, 34, the patches 40, 42, 44, the apertures 50, 52, and 54, and the thickness of the dielectric layers 12 and 14, are individually calculated so that a high-order standing wave (i.e., a standing wave defining a mode other than a fundamental mode) is formed in the antenna cavity, defined within the dielectric layers 12 and 14, and so that fields radiated from the radiating edges 40*a*, 40*b*, 42*a*, 42*b*, 44*a*, 44*b* interfere constructively with one another. Additionally, the size and location of the slots 30, 32, and 34, and of the apertures 50, 52, and 54, are calculated for controlling not only the resonant frequency, but also the input impedance, of the antenna 10. Such calculations may be performed by assuming that the vertical electric field components (as viewed in FIGS. 1 and 2) vanish at the boundaries of each element, so that the antenna 10, as most clearly shown in FIG. 2, then consists of a combination of a center section depicted as a section 60, and outer periodic annular sections depicted as sections 62 and 64. The vertical components of the electric fields are proportional to cos $\theta$, where $\theta$ is the angle between first and second lines extending from the center of the antenna 10, the first line passing through the feed point (described below) of the antenna, and the second line passing through a point of interest in the antenna. It can be appreciated then that the field distribution within the antenna cavity affects the desired radiation and the input impedance of the antenna 10. The number of periodic annular sections 62 and 64 determine not only the overall size, but also the directivity, of the antenna 10. The sidelobe levels of the antenna 10 are determined by the field distribution at the radiating edges 40*a*, 40*b*, 42*a*, 42*b*, 44*a*, 44*b*. Therefore, antenna characteristics, such as directivity, sidelobe levels, and input impedance are controlled by the width and the position of each of the strips 20, 22, 24, and 26, and of each of the patches 40, 42, and 44. To achieve high directivity, the field distribution at the radiating edges 40*a*, 40*b*, 42*a*, 42*b*, 44*a*, 44*b* is assumed to be as uniform as possible. There are electric field null points in the dielectric layer 14 between adjacent slots 30, 32, and 34. In some instances, vertical shortening pins (not shown) may be disposed in the antenna 10 to suppress unwanted mode excitations. The foregoing calculations and analysis utilize techniques, such as the cavity model and the moment method, discussed, for example, by C. S. Lee, V. Nalbandian, and F. Schwering in an article entitled "Planar dual-band microstrip antenna", published in the *IEEE Transactions on Antennas and Propagation*, Vol. 43, pp. 892–895, August 1995. Because such techniques are well known in the art, they will not be discussed in further detail herein.

A first conventional SMA probe 70 is provided for feeding a linear polarized (LP) signal from a cable (not shown) to a feed point in the antenna 10. The SMA probe 70 includes, for delivering EM energy to and/or from the antenna 10, an outer conductor 72 which is electrically connected to the ground plane 16, an inner (or feed) conductor 74 which is electrically connected to the annular strip 26, and an annular dielectric 75 interposed between the inner and outer conductors 74 and 72, respectively. While the SMA probe 70 is preferred, any suitable coaxial probe and/or connection arrangement may be used to implement the foregoing connections. For example, a conductive adhesive (not shown) may be used to bond and maintain contact between the inner conductor 74 and the annular strip 26, and an appropriate seal (not shown) may be provided where the SMA probe 70 passes through the ground plane 16 to hermetically seal the connection. Though not shown, it is understood that the other end of the SMA probe 70, not connected to the antenna 10, is connectable via a coaxial cable (not shown) to a signal generator or to a receiver such as a satellite signal decoder used with television signals.

In operation, the antenna 10 may be used for receiving and/or transmitting beams. To exemplify how the antenna may be used to receive a beam, the antenna 10 may be positioned in a residential home and directed for receiving from a geostationary, or equatorial, satellite a beam carrying a television signal within a predetermined frequency band or channel. The antenna 10 is so directed by orienting the top surface 14*a* toward the source of the beam so that it is generally perpendicular to the direction of the beam. Assuming that the elements of the antenna 10 are correctly sized for receiving such satellite signals, then the beam will pass through the apertures 50, 52, and 54, and induce a standing wave which will resonate between the two dielectric layers 12 and 14. A standing wave induced in the transmission-line cavity defined by the dielectric layer 12 is communicated through the SMA probe 70 to a receiver such as a decoder (not shown). It is well known that antennas transmit and receive signals reciprocally. It can be appreciated then that operation of the antenna 10 for transmitting signals is reciprocally identical to that of the antenna for receiving signals. The transmission of signals by the antenna 10 will, therefore, not be further described herein.

Figure 3:
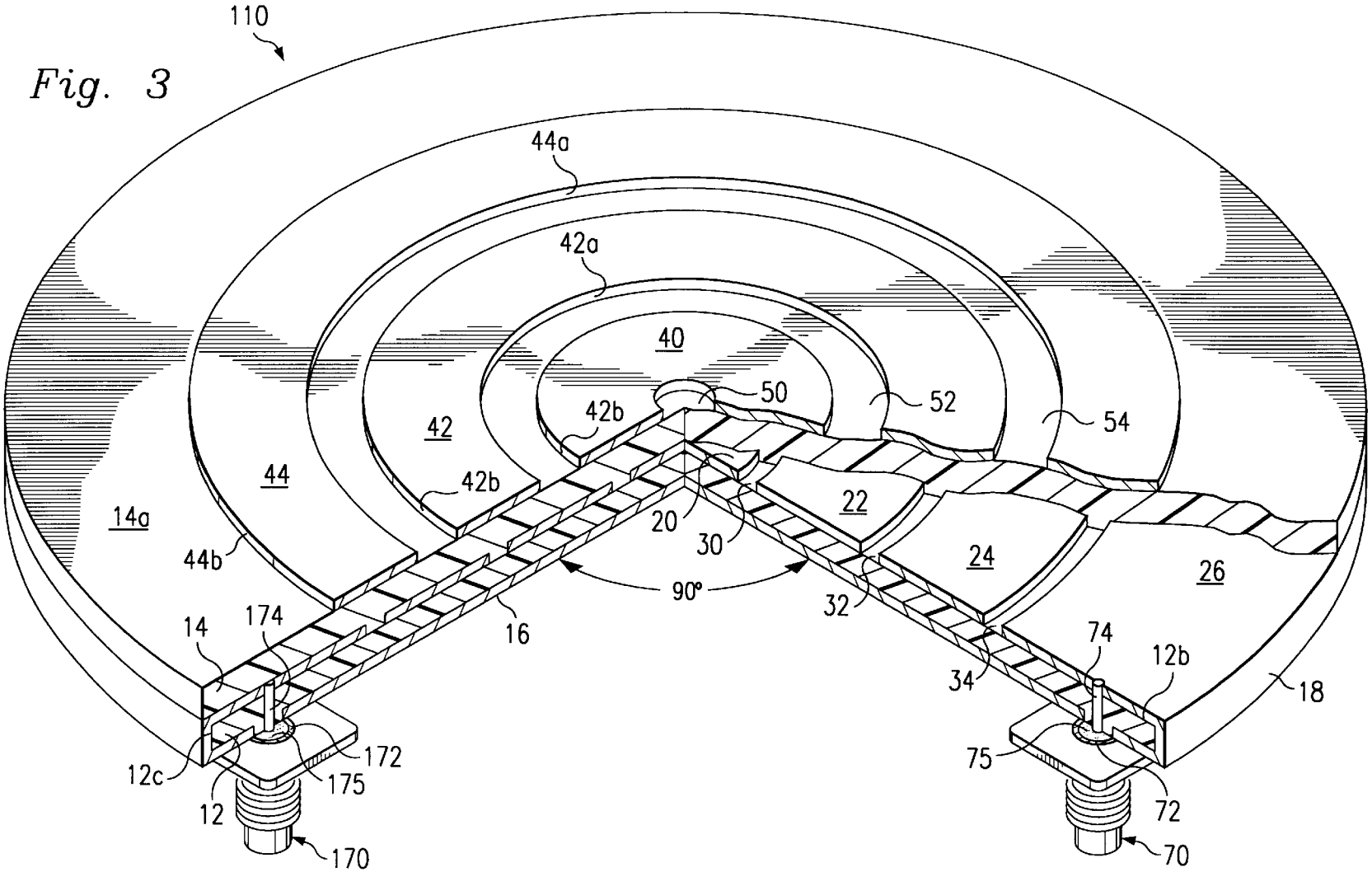
FIG. 3 is a partially cut-away perspective view of an alternate embodiment of a planar antenna embodying features of the present invention.

The embodiment shown in FIG. 3 is virtually identical to that shown in FIGS. 1 and 2, and identical components are given the same reference numerals. According to the embodiment of FIG. 3, then, an antenna 110 is adapted for receiving and/or transmitting circularly polarized (CP) signals rather than LP signals. To this end, the antenna 110 includes a second conventional SMA probe 170 angularly spaced from the first SMA probe 70 by 90° (i.e., orthogonal to the first SMA probe 70, as indicated in FIG. 3). The SMA probe 170 includes, for delivering EM energy to and/or from the antenna 10, an outer conductor 172 which is electrically connected to the ground plane 16, an inner (or feed) conductor 174 which is electrically connected to the annular strip 26, and an annular dielectric 175 interposed between the inner and outer conductors 172 and 174, respectively. The SMA probe 170 may be connected to the antenna 110 in the same manner that the SMA probe 70 was connected to the antenna 10.

Operation of the antenna 110 is virtually identical to that of the antenna 10, except that, to transmit CP radiation, the two probes 70 and 170 must be fed with signals having a phase difference of 90°.

The present invention as embodied in FIGS. 1–3 has several advantages. For example, when the input impedance of the antenna 10 or 110 of the present invention is matched, incoming EM energy is dissipated through conduction loss, dielectric loss, and radiation loss. The conduction and dielectric losses are relatively small though and, as a consequence, most of the EM energy is radiated as a beam, resulting in an aperture efficiency exceeding 80%. This is an advantage over reflector antennas which incur significant losses in aperture efficiency from feed spillover and aperture blockage by a feed assembly, typically resulting in an aperture efficiency of only about 55%. While high aperture efficiencies are thus readily achievable by the antennas of the present invention, such efficiencies are difficult to achieve even with expensive, sophisticated reflector antennas.

In addition to providing performance superior to that which is available with reflector antennas, the antennas of the present invention are also much smaller, lighter, and less bulky than are reflector antennas. Because the antennas of the present invention are also flat and thin, they may be readily mounted on a simpler, less expensive frame than a reflector antenna may be mounted on. The antennas of the present invention may also be readily mounted inside a residential dwelling, such as on a television or in an attic, for receiving beams transmitted from satellites, thereby obviating problems associated with weather. Furthermore, the antennas of the present invention may be manufactured much more simply than reflector antennas and, therefore, may be provided at a small fraction of the cost of a conventional reflector antenna.

It is understood that the present invention can take many forms and embodiments. The embodiments described herein are intended to illustrate rather than to limit the invention. Accordingly, several variations may be made in the foregoing without departing from the spirit or the scope of the invention. For example, additional periodic sections 62 may be provided for reducing the beamwidth, or fewer periodic sections 62 may be utilized to reduce the physical space required for the antennas of the present invention. The antennas of the present invention may also be configured with a generally non-circular shape, such as an elliptical shape, rather than a circular shape. Still further, the antennas of the present invention may be configured so that the strip 20 defines a hole centrally formed therein, and so that the patch 40 does not define the aperture 50.

In still further variations, any number of SMA probes 70, 170 may be connected to the antennas 10, 110 of the present invention in the manner described above at any of a number of different feed points extending from the ground plane 16 to any of the strips 20, 22, 24, or 26. A plurality of SMA probes may thus be connected to feed points located the same radial distance from the center of the antenna, all of which feed points are equally effective for the transmission and/or reception of a beam of EM energy. For example, provided that the SMA probes 70 and 170 are angularly spaced apart 90°, the outer conductors 72, 172 may be connected to any point which is equidistant from the center of the antenna of the present invention, and the inner conductors 74, 174 may be electrically connected to any of the strips 20, 22, 24, and/or 26 where multiple feed points are possible for input impedance matching. It is noted that, while the outermost feed locations are generally preferable for simplicity of fabrication, it may be preferable for relatively large aperture antennas to connect the SMA probes 70, 170 to feed points extending from the ground plane 16 to the center strip 20. Furthermore, multiple SMA probes 70, 170 may be connected at any of the foregoing feed points of either of the antennas 10, 110 for providing the input and/or output of a number of different signal channels or bands to and/or from the antenna, thereby enabling the antennas 10, 110 to be used for dual-polarization applications. Moreover, where multiple resonant modes are utilized, dualband as well as multi-band operations are feasible. The SMA probes, which are adapted for feed from coaxial cable, may be replaced with other feed configurations, such as microstrip-line feeds, or aperture-coupled feeds.

Figure 4:
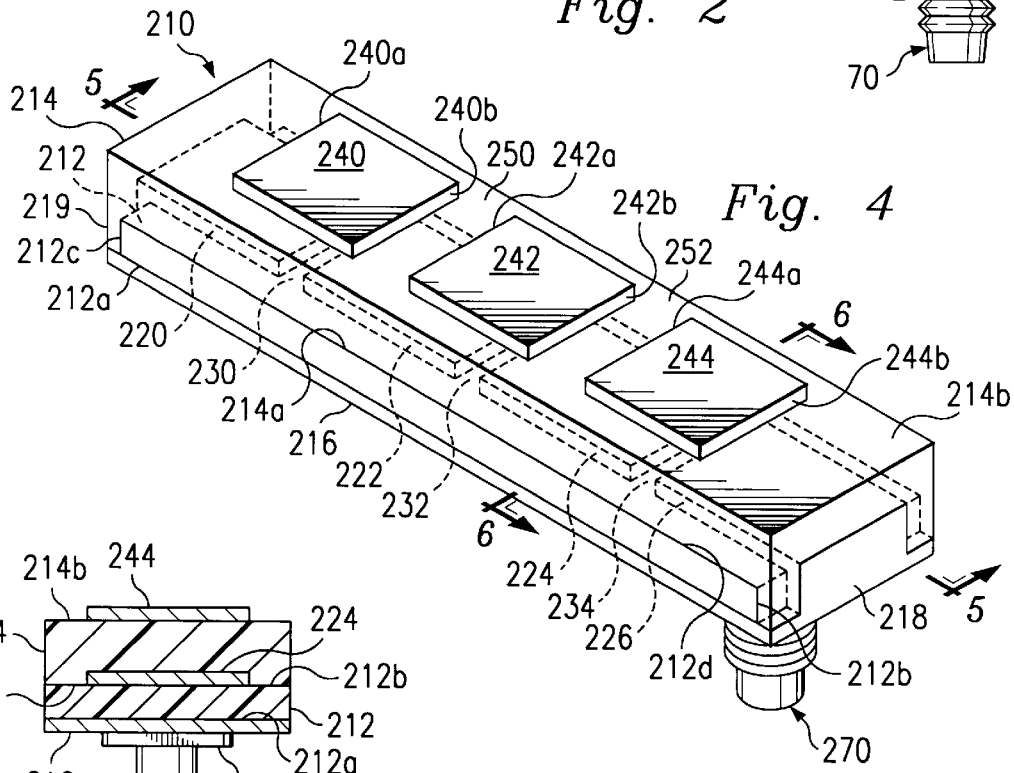
FIGS. 4 is a perspective view of a linear array antenna embodying features of the present invention.
Figure 6:
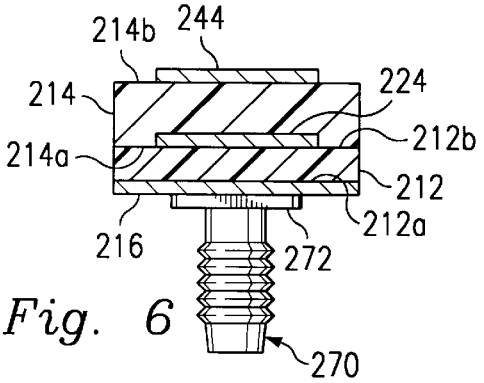
FIG. 6 is an elevational view of the antenna of FIG. 4 taken along the line 6—6 of FIG. 4.
Figure 5:
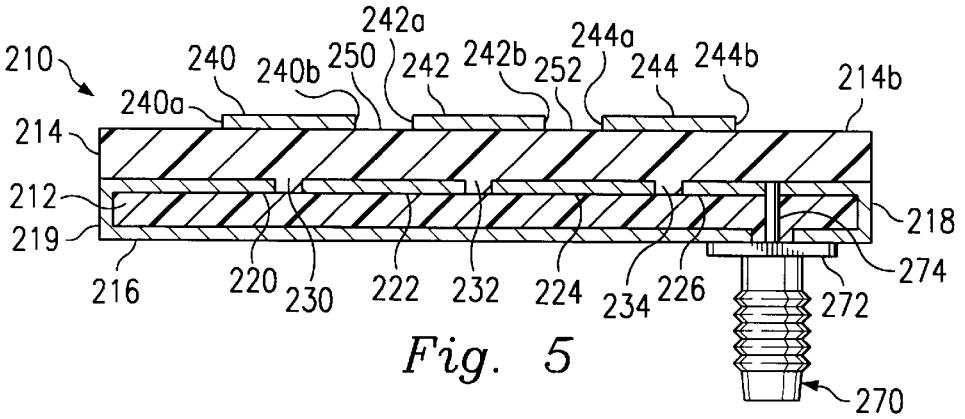
FIG. 5 is a elevational view of the antenna of FIG. 4 taken along the line 5—5 of FIG. 4.

FIGS. 4–6 depict an alternate embodiment of the present invention in which the reference numeral 210 refers in general to a linear antenna embodying features of the present invention for the transmission and reception of EM energy. As viewed in FIG. 4, the antenna 210 includes first and second parallelogram-shaped dielectric layers 212 and 214, respectively, fabricated from a mechanically stable material, such as RT/duroid™ 5880, having a relatively low dielectric constant, such as 2.2, and having a thickness (i.e., the vertical dimension, as viewed in FIGS. 4–6) that is determined as described above with respect to the dielectric layers 12 and 14, respectively. The length and width of the layers 212 and 214 are determined by the number of strips and patches used, and depend on the desired directivity and the physical size of the antenna, as discussed below.

The first dielectric layer 212 defines a bottom side 212*a* to which a ground plane 216 is bonded, ends 212*b* and 212*c* to which respective end conductors 218 and 219 are bonded, and a top side 212*d* to which an array of four spaced conducting strips 220, 222, 224, and 226 are bonded, for forming a linear transmission-line cavity with the dielectric layer 212. Each of the strips 220, 222, 224, and 226 have a thickness (which, for the sake of clarity, is not shown to scale in FIGS. 4–6) of approximately 1 mil (0.001 inch), and a length (i.e., the horizontal dimension as viewed in FIG. 5) of approximately $\lambda/2$. The width (i.e. the horizontal dimension as viewed in FIG. 6) of each of the strips 220 and 226 is preferably between $\lambda/2$ and $3\lambda/4$, and of each of the strips 222 and 224 is approximately $\lambda/2$. The strips 220, 222, 224, and 226 are spaced apart to form between adjacent strips thereof three slots 230, 232, and 234, each of which slots have widths (FIG. 5) preferably between 0.01 $\lambda$ and 0.20 $\lambda$. The ground plane 216, end conductors 218 and 219, and strips 220, 222, 224, and 226 are formed from conductive materials, such as copper, aluminum, and silver, and are preferably bonded to the dielectric 212 using conventional printed-circuit, metallizing, decal transfer, MMIC techniques, or chemical etching techniques, or any other suitable technique, as described above with respect to the embodiments of FIGS. 1–3.

The second dielectric layer 214 defines a bottom surface 214*a* which is bonded to the top surface 212*d* of the first dielectric layer 212 and to the strips 220, 222, 224, and 226 using any suitable technique, such as creating a bond with very thin (e.g., 1.5 mil) thermal bonding film (not shown) with a dielectric constant on the order of 2.3. The second dielectric layer 214 further defines a top surface 214*b* to which three radiating patches 240, 242, and 244 are bonded using conventional printed-circuit, metallizing, decal transfer, MMIC techniques, or chemical etching techniques, or any other suitable technique, as discussed above. The patches 240, 242, and 244 define radiating edges 240*a*, 240*b*, 242*a*, 242*b*, 244*a*, and 244*b*, and are positioned so that they are approximately centered over the slots 230, 232, and 234, and are spaced apart so that two apertures 250 and 252 are formed between adjacent patches. Each of the patches 240, 242, and 244 have lengths (FIG. 5) preferably between $\lambda/4$ and $\lambda/2$, and widths (FIG. 6) of approximately $\lambda/2$, and each of the apertures 250 and 252 have widths (FIG. 5) preferably between 0.01 $\lambda$ and 0.20 $\lambda$.

For optimal performance at a particular frequency, the widths of the strips 220, 222, 224, 226, the slots 230, 232, 234, the patches 240, 242, 244, and the apertures 250 and 252, as well as the number of strips, slots, patches, and apertures, and the thickness of the dielectric layers 212 and 214, should be individually calculated so that the EM energy radiated from the radiating edges 240*a*, 240*b*, 242*a*, 242*b*, 244*a*, and 244*b* of the dielectric layer 214 interferes constructively with one another. In performing such calculations, it can be appreciated that the beamwidth in the longitudinal direction (FIG. 5) is affected by the number of strips 220–226 and patches 240–244, and that the beamwidth in the transverse direction (FIG. 6) is affected by the width of the strips and patches. Because such calculations and analysis utilize techniques, as discussed above, which are well known to those skilled in the art, they will not be discussed in further detail herein.

An SMA probe 270 is provided for feeding EM energy from a cable (not shown) to the antenna 210. The SMA probe 270 includes, for delivering EM energy to and/or from the antenna 210, an outer conductor 272 which is electrically connected to the ground plane 216, an inner (or feed) conductor 274 which is electrically connected to the strip 226, and an annular dielectric (not shown) interposed between the inner and outer conductors 272 and 274, respectively. As discussed in greater detail above with respect to the SMA probe 70, any suitable connection arrangement may be used to implement the foregoing connections. Though not shown, it is understood that the other end of the SMA probe 270, not connected to the antenna 210, is connectable via a coaxial cable (not shown) to a signal generator or to a receiver such as a satellite signal decoder used with television signals.

Figure 7:
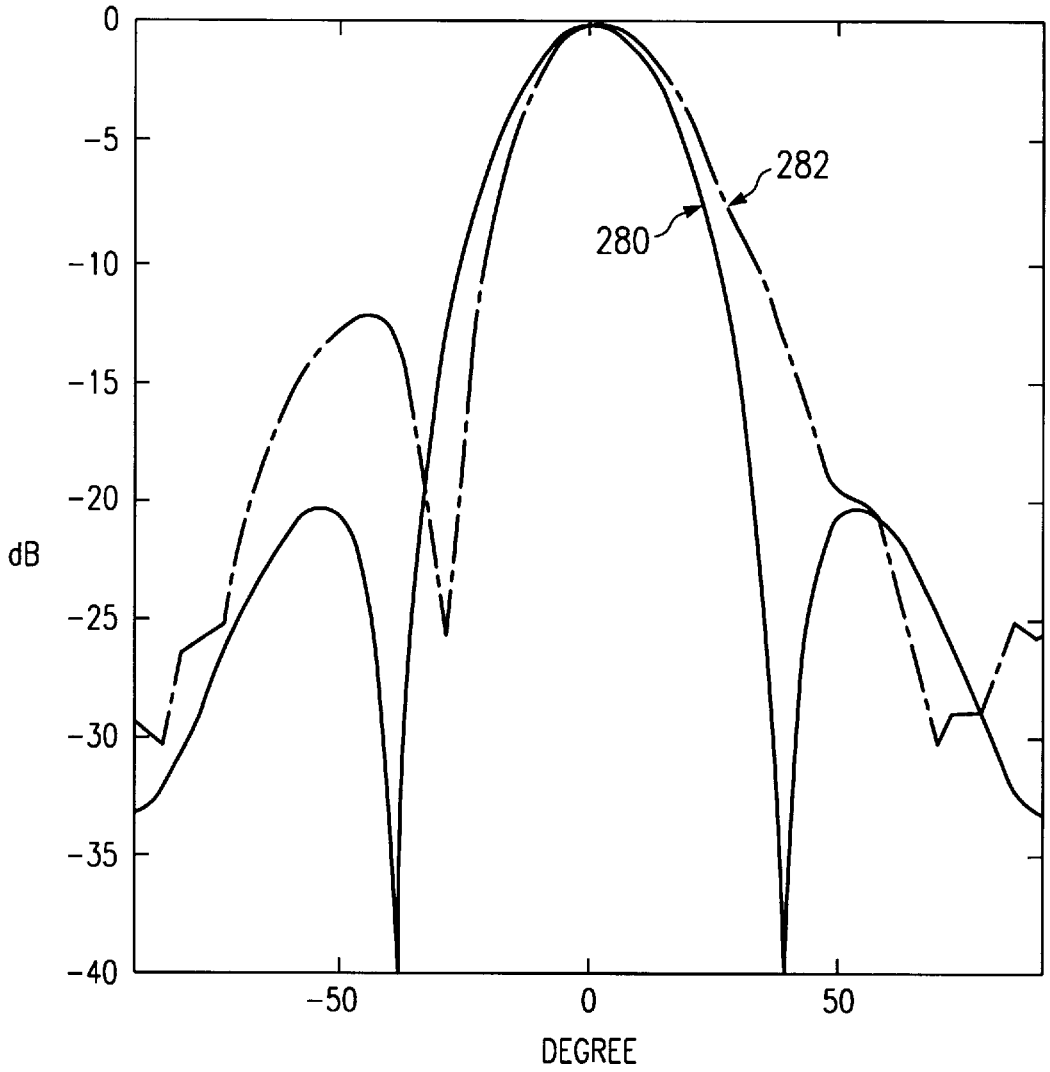
FIG. 7 is a chart depicting E-plane radiation patterns of the antenna of FIGS. 4–6 in response to a 4.10 GHz signal.

The operation of the antenna 210 is similar to the operation of the antennas 10, 110, and will, therefore, not be described in any further detail, except by way of an example. Accordingly, the antenna 210 has been configured with dielectric layers 212 and 214 formed from Rogers RT/duroid™ 5880 of a thickness of 62 mils and a dielectric constant of 2.2. As viewed in FIG. 5, the strips 220 and 226 are 54 mm long, the strips 222 and 224 are 40 mm long, the slots 230, 232, 234 are 2 mm wide, the patches 240, 242, 244 are 34 mm long, and the apertures 250 and 252 are 4 mm wide. As viewed in FIG. 6, the width of the strips and patches, and the length of the slots and apertures is 25 mm. The E-plane radiation pattern resulting from such configuration in response to a 4.10 GHz EM signal input thereto is shown in FIG. 7. Specifically, the solid line 280 depicts the theoretical radiation pattern, and the dashed line 282 depicts the experimental radiation pattern. It can be appreciated that, while the experimental and theoretical patterns differ somewhat due to imprecise laboratory testing conditions, the experimental pattern substantially confirms the theoretical pattern.

In addition to the advantages of the embodiments of FIGS. 1–3, the embodiment of FIGS. 4–5 is less costly than the preceding embodiment to design and manufacture. It is noted, though, that the embodiment of FIGS. 4–5 is generally less efficient than the embodiments of FIGS. 1–3, due to leakage of EM energy from the non-conductive sides thereof.

It is understood that the embodiment of FIGS. 4–5 of the present invention can take many forms and embodiments. The embodiments described herein are intended to illustrate rather than to limit the invention. Accordingly, several variations may be made in the foregoing without departing from the spirit or the scope of the invention. For example, the linear array may be wrapped around a conducting cylinder to produce "donut-shaped" radiation patterns which are useful for base station transmission in wireless communications. The sides of the antenna 210 may be provided with a conductive surface to prevent leakage of EM energy therefrom, thereby enhancing the efficiency of the antenna.

It is understood, too, that any of the antennas 10, 110, or 210 configured for operation at one frequency, may be reconfigured for operation at any other desired frequency, without significantly altering characteristics, such as the radiation pattern and efficiency of the antenna at the one frequency, by generally scaling each dimension of the antenna in direct proportion to the ratio of the desired frequency to the one frequency, provided that the dielectric constant of the dielectric layers is the same at the desired frequency as at the one frequency. Additionally, the dielectric layers 12, 14, 212, and 214 may be fabricated from materials having dielectric constants other than 2.2, and from materials that are mechanically unstable. Still further, the layers 12 and 14 may be fabricated from different materials having different dielectric constants, and the layers 212 and 214 may be fabricated from different materials having different dielectric constants.

Although illustrative embodiments of the invention have been shown and described, a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. An antenna comprising:

a first dielectric layer having first and second sides, a conductive ground plane disposed on the first side of the first dielectric layer;

an array of conducting strips disposed on the second side of the first dielectric layer, each of the strips being spaced apart to form a slot between each pair of adjacent strips;

a second dielectric layer having first and second sides, the first side of the second dielectric layer being bonded to the second side of the first dielectric layer and to the array of conducting strips;

an array of radiating patches disposed on the second side of the second dielectric layer, each of the patches being located over one and only one of the slots and partially overlapping two and only two of the conducting strips, each of the patches being spaced to form an aperture between each pair of adjacent patches;

a probe having an outer conductor and an inner conductor, the outer conductor being electrically connected to the ground plane, and the inner conductor being electrically connected to one of the array of conducting strips to feed electromagnetic energy to and/or extract electromagnetic energy from the antenna.

2. The antenna of claim 1 wherein the first and second dielectric layers are fabricated from a mechanically stable material.

3. The antenna of claim 1 wherein the first dielectric layer defines a peripheral edge having a conductive surface.

4. The antenna of claim 1 wherein, responsive to RF energy, a standing wave is induced in the antenna.

5. The antenna of claim 4 wherein the standing wave is a highorder standing wave.

6. The antenna of claim 1 wherein the first and second dielectric layers have the geometric shape of parallelograms.

7. The antenna of claim 1 further comprising a bonding film interposed between the first and second dielectric layers for bonding the layers together.

8. An antenna comprising:

a first dielectric layer having first and second sides;

a conductive ground plane disposed on the first side of the first dielectric layer;

an array of conducting strips disposed on the second side of the first dielectric layer, each of the strips being spaced apart to form a slot between each pair of adjacent strips;

a second dielectric layer having first and second sides, the first side of the second dielectric layer being bonded to the second side of the first dielectric layer and to the array of conducting strips;

an array of radiating patches disposed on the second side of the second dielectric layer, each of the patches being located over one and only one of the slots and partially overlapping two and only two of the conducting strips, each of the patches being spaced to form an aperture between each pair of adjacent patches; and a probe connected to feed electromagnetic energy to and/or extract electromagnetic energy from the antenna, wherein the probe is connectable to a coaxial cable.

9. An antenna comprising:

a first dielectric layer having first and second sides;

a conductive ground plane disposed on the first side of the first dielectric layer;

an array of conducting strips disposed on the second side of the first dielectric layer, each of the strips being spaced apart to form a slot between each pair of adjacent strips;

a second dielectric layer having first and second sides, the first side of the second dielectric layer being bonded to the second side of the first dielectric layer and to the array of conducting strips;

an array of radiating patches disposed on the second side of the second dielectric layer, each of the patches being located over one and only one of the slots and partially overlapping two and only two of the conducting strips, each of the patches being spaced to form an aperture between each pair of adjacent patches; and a probe connected to feed electromagnetic energy to and/or extract electromagnetic energy from the antenna, wherein the probe is an SMA probe connectable to a coaxial cable.

10. An antenna comprising:

a first dielectric layer having fist and second sides;

a conductive ground plane disposed on the first side of the first dielectric layer;

an array of conducting strips disposed on the second side of the first dielectric layer, the array of strips being spaced apart to form a slot between each pair of adjacent strips;

a second dielectric layer having first and second side, the first side of the second dielectric layer being bonded to the second side of the first dielectric layer and to the array of strips; and an array of radiating patches disposed on the second side of the second dielectric layer, each patch being located over one of the slots, the array of patches being spaced to form an aperture between each pair of adjacent patches;

wherein the first and second dielectric layers are round, disc-shaped, and concentric, and wherein the array of strips, the slots, the array of patches, and the apertures are annular and concentric with the first and second dielectric layers.

11. The antenna of claim 8 further comprising first and second probes connected to feed electromagnetic energy to and/or extract electromagnetic energy from the antenna, the first and second probes being angularly spaced 90° apart for transmitting and/or receiving a circularly polarized beam.

12. The antenna of claim 10 further comprising a probe connected to feed electromagnetic energy to and/or extract electromagnetic energy from the antenna.

13. The antenna of claim 12 wherein the probe includes an outer conductor and an inner conductor, the outer conductor being electrically connected to the ground plane, and the inner conductor being electrically connected to one of the array of conducting strips.

14. The antenna of claim 12 wherein the probe is adapted to be connected to a coaxial cable.

15. The antenna of claim 12 wherein the probe is an SMA probe adapted to be connected to a coaxial cable.

16. The antenna of claim 10 further comprising a microstrip line connected to feed electromagnetic energy to and/or extract electromagnetic energy from the antenna.

17. The antenna of claim 10 further comprising an aperture-coupled line connected to feed electromagnetic energy to and/or extract electromagnetic energy from the antenna.

18. The antenna of claim 10 wherein the first and second dielectric layers are fabricated from a mechanically stable material.

19. The antenna of claim 10 wherein the first dielectric layer defines a peripheral edge having a conductive surface.

20. The antenna of claim 10 wherein, responsive to RF energy, a standing wave is induced in the antenna.

21. The antenna of claim 20 wherein the standing wave is a high-order standing wave.

22. The antenna of claim 10 wherein the first and second dielectric layers have the geometric shape of parallelograms.

23. The antenna of claim 10 further comprising a bonding film interposed between the first and second dielectric layers for bonding the layers together.

24. A microstrip array antenna comprising:

a first dielectric layer having first and second opposing sides;

a conductive ground plane secured the first side of the first dielectric layer;

an array of conducting strips secured to the second side of the first dielectric layer, the array of strips being spaced apart to form a slot between each pair of adjacent strips;

a second dielectric layer having first and second opposing sides, the first side of the second layer being secured to the second side of the first dielectric Layer and to the array of strips;

an array of radiating patches secured to the second side of the second dielectric layer, each of which patches is positioned over one of the slots, the array of patches being spaced to form an aperture between each pair of adjacent patches; and wherein the strips, slots, patches and apertures are sized so that, responsive to electromagnetic energy, a high-order standing wave is induced in the antenna;

wherein the first and second dielectric layers are round, disc-shaped, and concentric, and wherein the array of strips, the slots, the array of patches, and the apertures are annular and concentric with the first and second dielectric layers.

25. The antenna of claim 24 wherein the first dielectric layer defines a peripheral edge having a conductive surface.

26. The antenna of claim 24 further comprising a probe to feed electromagnetic energy to and/or extract electromagnetic energy from the antenna.

27. The antenna of claim 26 wherein the probe includes an outer conductor and an inner conductor, the outer conductor being electrically connected to the ground plane, and the inner conductor being electrically connected to one of the array of conducting strips.

28. An antenna comprising:

two dielectric layers bonded together with array of conducting strips interposed therebetween, the strips being spaced to define a slot between each pair of adjacent strips;

a conductive ground plane disposed on a first outer side of the two bonded dielectric layers; and an array of radiating patches disposed on a second outer side of the two bonded dielectric layers, each of which patches is positioned over a corresponding slot, the array of patches being spaced apart to form an aperture between each pair of adjacent patches so that responsive, to electromagnetic energy, a high-order standing wave is induced in the antenna and a directed beam is transmitted from or received into the antenna;

wherein the two dielectric layers are round, disc-shaped, and concentric, and wherein the array of strips, the slots, the array of patches, and the apertures are annular and concentric with respect to the first and second dielectric layers.

29. The antenna of claim 28 wherein the antenna further comprises first and second means angularly spaced 90° apart for transmitting and/or receiving a circularly polarized beam.

30. The antenna of claim 28 wherein the dielectric layer having a ground plane disposed thereon further defines a peripheral edge having a conductive surface.

31. The antenna of claim 28 further comprising means for feeding electromagnetic energy to and/or extracting electromagnetic energy from the antenna.

32. The antenna of claim 28 wherein first and second dielectric layers have the geometric shape of parallelograms, and each of the strips and patches are rectangular.

* * * * *